United States Patent [19]

Wilkinson et al.

[11] Patent Number: 4,643,317

[45] Date of Patent: Feb. 17, 1987

[54] COMBINATION SPORTS EQUIPMENT STORAGE RACK AND BALL RETRIEVER

[76] Inventors: William F. Wilkinson, Old Meadow Rd., Seaford, Del. 19973; William T. Wilkinson, Morris Farm, Rte. 841, Kemblesville, Pa. 19347

[21] Appl. No.: 748,822

[22] Filed: Jun. 26, 1985

[51] Int. Cl.[4] ..... A47F 7/00

[52] U.S. Cl. ..... 211/14; 211/60.1; 211/113; 273/29 A; 294/19.2

[58] Field of Search ..... 211/60.1, 14, 13, 88, 211/113; 273/29 A, 32 D; 224/919, 248, 249; 294/19.2, 137; 248/145.6

[56] References Cited

U.S. PATENT DOCUMENTS

| | | | |
|---|---|---|---|
| 3,371,950 | 3/1968 | Stap | 294/19.2 X |
| 3,460,789 | 8/1969 | McKirdy et al. | 211/113 X |
| 3,858,725 | 1/1975 | Pietrack et al. | 211/13 |
| 3,904,041 | 9/1975 | Medgebow | 211/88 X |
| 4,116,340 | 9/1978 | Nelson et al. | 211/13 |
| 4,461,504 | 7/1984 | Perez et al. | 294/19.2 |

FOREIGN PATENT DOCUMENTS

| | | | |
|---|---|---|---|
| 446938 | 3/1948 | Canada | 211/14 |

*Primary Examiner*—Ramon S. Britts
*Assistant Examiner*—Blair Johnson

[57] ABSTRACT

A combination sports equipment storage rack and ball retriever includes a support member which is attached to a fixed surface. The support member includes a pair of wing portions to which sports equipment such as rackets may be mounted. A ball retriever is detachably mounted to the support member at a central portion between the wing portions. The ball retriever includes an elongated handle and a basket. The bottom wall of the basket is formed from spaced parallel resiliently mounted rod members for retrieving balls by pressing downwardly with the basket against the balls. When the ball retriever is attached to the support member, the basket may be used for storing other sports equipment such as cans of balls.

10 Claims, 3 Drawing Figures

COMBINATION SPORTS EQUIPMENT STORAGE RACK AND BALL RETRIEVER

BACKGROUND OF THE INVENTION

This invention relates to a combination of sports equipment storage rack and ball retriever. The growing interest in participant sports has resulted in the availability of various types of sports equipment for a particular sport. For example, a tennis player would generally have at least one tennis racket, numerous cans of balls and various other sundry equipment such as wrist bands, head bands, sun visors, gloves and caps. Various devices exist for storing such equipment. In general these devices comprise a storage rack which is mounted in a fixed position.

Apart from storage racks for sports equipment, another known item used by sports enthusiasts, particularly tennis players, is a ball retriever which is used for picking up balls particularly during or after practice sessions. At such times, a player who, for example, is practicing his serve might have a dozen or more balls scattered about the court. The general structure of a ball retriever is a wire basket having an elongated handle with the rod members on the bottom wall of the basket spaced apart a distance slightly less than the diameter of the tennis balls. In use the player would hold the handle and position the basket above a ball and then press downwardly. As a result, the springy rod members would spread sufficiently to permit the ball to pass into the basket and be held therein by the rod members returning to their original position. Such ball retrievers are convenient because they permit the player to gather the balls without any bending or stooping action.

SUMMARY OF THE INVENTION

An object of this invention is to provide a unitary device which could function as a sports equipment storage rack and as a ball retriever.

A further object of this invention is to provide such a device wherein the ball retriever could be detached from the storage rack and thus function as a ball retriever and then later be remounted to the storage rack whereupon the ball retriever itself could have storage functions.

In accordance with this invention, a combination sports equipment storage rack and ball retriever is provided which comprises a support member having a pair of wing portions to which various sports equipment may be mounted. A ball retriever is also provided in the form of a basket having a bottom wall through which balls may enter. An elongated handle extends upwardly from the basket. The ball retriever is detachably mounted to the support member by means of the elongated handle.

The handle of the ball retriever may be in flat form to which fasteners such as hooks or pegs may be secured. In this version, when the ball retriever is mounted to the support member, various sports equipment my be suspended from the hooks or pegs. The basket itself may have solid walls which in turn may also be provided with hooks or pegs on which other sports equipment may be mounted.

THE DRAWINGS

DETAILED DESCRIPTION

Figure 1:
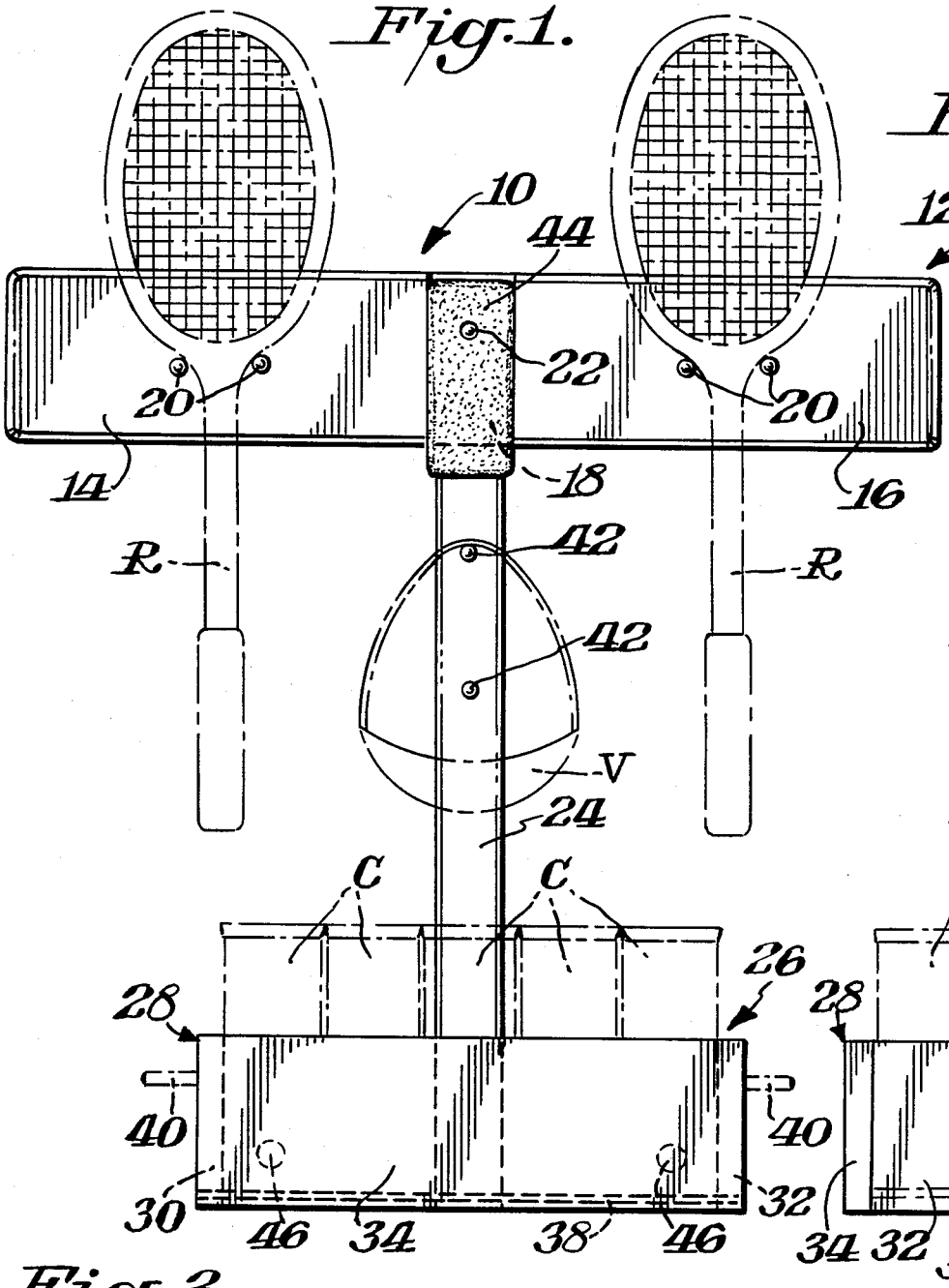
FIG. 1 is a front elevation view of a combination sports equipment storage rack and ball retriever in accordance with this invention.
Figure 2:
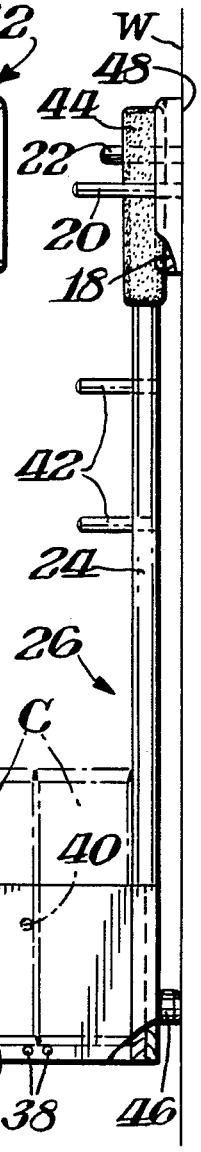
FIG. 2 is a side elevation view partly broken away of the storage rack and ball retriever shown in FIG. 1.
Figure 3:
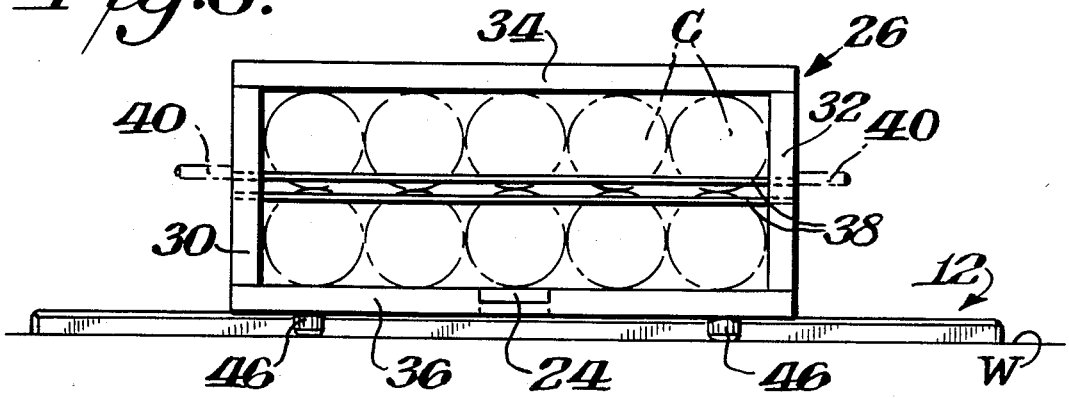
FIG. 3 is a bottom plan view of the storage rack and ball retriever shown in FIGS. 1–2.

FIGS. 1–3 illustrate a device 10 which functions as a combination storage rack and ball retriever. As shown therein, device 10 includes a support member 12 which comprises a pair of wing portions 14, 16 on each side of a central portion 18. Each wing portion 14 and 16 includes a set of pegs 20. Central portion 18 also includes at least one peg 22.

As shown in FIG. 2, central portion 18 is recessed or dished out to accommodate the remote end of an elongated handle 24 of the ball retriever 26.

Ball retriever 26 includes a basket 28 having an upstanding peripheral side wall which includes portions 30, 32 intermediate front portion 34 and rear portion 36.

As best shown in FIGS. 2 and 3, basket 28 has a bottom wall which is formed by spaced parallel resiliently mounted rod members 38. Each rod member 38 is spaced from a respective side wall portion 34 or 36 by a distance slightly smaller than the diameter of an associated ball such as a tennis ball. The overall distance between side wall portions 34, 36, it is such as to accommodate two rows of ball cans. For example, a conventional tennis ball can would have a diameter of about three inches and the distance between side wall portions 34 and 36 would thus be about six inches.

Ball retriever 26 and particularly its bottom wall thereof is formed along the operating principles of known ball retrievers wherein the springy bottom wall members 38, 38 permit a ball to be captured in the basket 28 by pressing the basket 28 downwardly onto a ball whereby the balls deflect the resilient rod members a sufficient extent for the balls to pass into the downwardly urged basket 28. Once the major diameter of the balls pass into the basket, the resilient rod members return to their original position and prevent the balls from falling through the bottom wall.

Ball retriever device 26 differs from conventional ball retrievers in its side wall and handle structure. As shown in the drawings, the side wall is formed of a solid material rather than individual wires as with conventional ball retrievers. A number of functions are achieved by this structure. For example, the solid wall form would be more in keeping with support member 12 by, for example, being made of the same or similar material so that both the support member and ball retriever are aesthetically compatible. In addition, the solid wall structure of the ball retriever permits suitable fasteners such as hooks or pegs 40 to be secured to the ball retriever 26 for holding various sports equipment such as bands, caps or visors.

As previously indicated, handle 24 also differs in structure from conventional ball retriever handles. In this regard, conventional handles are also formed of a wire or rod type structure. Handle 24 is formed of solid flat material which again would be aesthetically compatible with basket 28 and support member 12. Additionally, the flat surface of handle 24 accommodates fastening members such as hooks or pegs 42 for the various sports equipment which may be suspended such as the sun visor illustrated in FIG. 1.

Since handle 24 is utilized as a handle during the ball retrieving, a padded gripping portion 44 is provided at the upper end of handle 24 to maximize comfort of the user when holding handle 24. In the illustrated embodiment a hole is formed in the upper end of gripping portion 44 for receiving the peg 22 of central portion 18 of support member 12.

As previously mentioned, central portion 18 is dished out or recessed. The dimensions thereof are such as to snugly accommodate gripping end 44 and handle 24.

In order to provide stability for ball retriever 26 when in its storage condition, a pair of stabilizing members such as buttons or posts 46 are provided on rear wall portion 36. Buttons 46 are dimensioned to terminate in the same plane as the rear surface 48 of support member 12 so as to maintain ball retriever 26 in proper position and add stability when the components are in the storage position.

The various solid surfaces of support member 12, handle 24 and the upstanding side wall of basket 28 may be made of any suitable material. For example, a solid wood may be used for any or all of those components. Alternatively, the components may be made of a suitable plastic material. A still further possibility is to provide a veneer of other suitable type of facing on any suitable material. The materials used may even be hollow, although it is desired that a solid appearance be formed and that the materials be capable of receiving the appropriate fasteners such as the hooks of pegs.

Similarly, the gripping portion of handle 24 is in intended to provide a comfortable surface for the user when basket 28 is used as a ball retriever. Desirably, however, the specific means of achieving this is intended to be aesthetically compatible with the remaining components of device 10. Thus a cushioning material which provides the necessary comfort should be of a color and structure so as to add to the overall aesthetic affect of device 10. Although gripping portion 44 is illustrated as being generally flat along the lines as the remaining portion of handle 24, other forms may be used. For example, gripping portion 44 may taper inwardly to result in a narrower dimension around which the user's fingers may easily grip. In such case, a bar or rod could extend along the upper end of the narrow portion to give a T structure which would be easy for the user to hold.

In operation, support member 12 would be permanently mounted by any suitable means such as screws to a fixed surface such as wall W with ball retriever 26 secured to support member 12.

Handle 24 would be removed from central portion 18 of support member 12. Where ball retriever 26 is used by a tennis player, the player might then take ball retriever 26 with him for retrieving the tennis balls after, for example, a practice session. Once the practice session has been completed, handle 24 would be again mounted to support member 12. Sports equipment such as the rackets R would be mounted to wing portions 14 and 16 by placement over sets of pegs 20, 20. Other equipment such as tennis ball cans C would be placed in basket 28. Other associated sports equipment such as sun visor V as well as wrist bands, head bands, gloves, etc. could also be suspended from the various other fasteners or pegs 40, 42. If desired, front wall 34 may also be provided with fasteners.

It is to be understood that the number, location or type of fasteners may be varied within the broad concepts of this invention. Similarly, although specific reference has been made to use of device 10 in connection with the sport of tennis, device 10 may be used for other sports such as raquetball or other racket sports. It is to be understood that device 10 has as its primary function an aesthetically pleasing and high utilitarian storage device. Thus device 10 could be used for storing equipment for a combination of sports. For example, support member 12 may be used for mounting tennis rackets at one wing portion and raquetball rackets, etc. at the other wing portion. Within the broad concepts of this invention, it is to be understood that ball retriever 26 has as its main function a unit which could be detached from a stationary support member with the detached unit then taken to a court or the like where it could serve some ancillary function such as retrieving or storing balls.

What is claimed is:

1. A combination sports equipment storage rack and ball retriever comprising a support member for attachment to a fixed surface, said support member having a pair of wing portions separated by a central portion, each of said wing portions including receptacle means to which a sports racket may be mounted, a ball retriever, said ball retriever including an elongated handle, a basket secured to said handle, said basket having a bottom wall and an upstanding peripheral side wall, said bottom wall being formed from spaced parallel resiliently mounted rod members whereby a ball may be inserted into and stored in said basket by pressing said bottom wall downwardly on a ball to cause said rod members to spread to permit the passage of the ball therethrough and then return to their original position to hold the ball therein, said handle being detachably mounted to said central portion of said support member whereby said support member and said basket may be used to store equipment and whereby upon detachment of said handle from said central portion said basket may be used for retrieving balls, said upstanding peripheral side wall of said basket being solid, said handle comprising a unitary vertically oriented bar being made of a flat solid material, including at least one hook member on said handle for holding sports equipment thereon, including cushioning material at the end of said handle to facilitate the gripping thereof, said receptacle means including sets of pegs, and said hook members comprising pegs, including pegs on said side wall of said basket for holding sports equipment thereon, including a peg mounted to said central portion, and said handle being mounted from said central portion peg, and said central portion being provided with an elongate recess snugly detachably receiving an upper portion of said unitary vertically oriented handle.

2. The combination of claim 1 wherein said side wall of said basket comprises front and rear and intermediate portions, and at least one stabilizer member on said rear portion extending outwardly therefrom and terminating in line with the rear surface of said support member to abut against the fixed surface when said ball retriever is mounted to said support member.

3. The combination of claim 2 wherein said basket is dimensioned to hold two rows of tennis ball cans therein.

4. The combination of claim 3, in further combination therewith, at least one sports racket held by each set of said pegs in said wing portions, and two rows of cans of balls being in said basket.

5. The combination of claim 4 including two pegs on said handle, and said side wall pegs being on said intermediate portions of said side wall, and including sports clothing held by said pegs on said handle and on said side wall.

6. A combination sports equipment storage rack and ball retriever comprising a support member in the form of an elongated bar for attachment to a fixed surface, said support member having a pair of wing portions separated by a central portion, each of said wing portions including a set of pegs to which a sports racket may be mounted, a ball retriever, said ball retriever including an elongated unitary, vertically oriented handle comprising a flat bar a basket secured to said handle, said basket having a bottom wall and an upstanding peripheral side wall, said bottom wall being formed from spaced parallel resiliently mounted rod members whereby a ball may be inserted into and stored in said basket by pressing said bottom wall downwardly on a ball to cause said rod members to spread to permit the passage of the ball therethrough and then return to their original position to hold the ball therein, an elongate recess in the said central portion of said support member, a hook in said recess, said handle being snugly received in said recess, and said handle being detachably mounted to hook in said central portion of said support member whereby said support member and said basket may be used to store equipment and whereby upon detachment of said handle from said central portion said basket may be used for retrieving balls.

7. The combination of claim 6 wherein said upstanding peripheral side wall of said basket is solid.

8. The combination of claim 7 wherein said handle is made of a flat solid material.

9. The combination of claim 8 including at least one hook member on said handle for holding sports equipment thereon.

10. The combination of claim 9 including cushioning material at the end of said handle to facilitate the gripping thereof.

* * * * *